US008136853B2

(12) United States Patent
Ito

(10) Patent No.: US 8,136,853 B2
(45) Date of Patent: Mar. 20, 2012

(54) VEHICLE DOOR HANDLE UNIT

(75) Inventor: Hidehiro Ito, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 966 days.

(21) Appl. No.: 12/099,324

(22) Filed: Apr. 8, 2008

(65) Prior Publication Data

US 2008/0250607 A1 Oct. 16, 2008

(30) Foreign Application Priority Data

Apr. 13, 2007 (JP) ..... 2007-105741

(51) Int. Cl.
*E05B 3/00* (2006.01)
*E05B 3/06* (2006.01)

(52) U.S. Cl. ..... 292/336.3

(58) Field of Classification Search ..... 292/336.3
See application file for complete search history.

(56) References Cited

U.S. PATENT DOCUMENTS

| | | | | | |
|---|---|---|---|---|---|
| 2,460,607 | A | * | 2/1949 | Sullivan | 74/503 |
| 4,232,892 | A | * | 11/1980 | Kuki | 292/347 |
| 4,634,161 | A | * | 1/1987 | Fukasawa et al. | 292/336.3 |
| 4,653,143 | A | * | 3/1987 | Ketelhut et al. | 292/336.3 |
| 4,838,590 | A | * | 6/1989 | Isomura | 292/336.3 |
| 5,011,202 | A | * | 4/1991 | Kato et al. | 292/336.3 |
| 5,613,717 | A | * | 3/1997 | Ha | 292/336.3 |
| 5,651,163 | A | * | 7/1997 | Tamaki | 292/336.3 |
| 5,794,994 | A | * | 8/1998 | Miyagawa et al. | 292/336.3 |
| 5,898,973 | A | * | 5/1999 | Schmidt | 16/445 |
| 6,976,717 | B2 | * | 12/2005 | Barr et al. | 292/336.3 |
| 7,360,808 | B2 | * | 4/2008 | Odahara et al. | 292/336.3 |
| 2010/0060019 | A1 | * | 3/2010 | Mizushima et al. | 292/336.3 |

FOREIGN PATENT DOCUMENTS

| | | |
|---|---|---|
| FR | 2865708 | 8/2005 |
| JP | 57-174661 | 11/1982 |
| JP | 60055187 | 3/1985 |
| JP | 60-203786 | 10/1985 |
| JP | 62078376 | 4/1987 |
| JP | 62248768 | 10/1987 |
| JP | 11-022256 | 1/1999 |
| JP | 2004-052506 | 2/2004 |
| JP | 2005-330752 | 12/2005 |
| JP | 2007126819 | 5/2007 |
| JP | 2007231711 | 9/2007 |

* cited by examiner

*Primary Examiner* — Carlos Lugo
(74) *Attorney, Agent, or Firm* — Rankin, Hill & Clark LLP

(57) ABSTRACT

Vehicle door handle unit includes: a handle shaft rotatably mounted on a vehicle door; a handle section pivotably mounted on the handle shaft; and a detection section for detecting locking/unlocking operation of the vehicle door or opening/closing-related operation including opening/closing operation of the vehicle door. The handle shaft includes first and second handle shaft members axially spaced apart from each other, and the detection section is provided between the first and second handle shaft members. Not only the vehicle door handle unit can be suitably applied to small vehicles etc. of which the vehicle door can only have a limited thickness, but also it can have a good usability.

11 Claims, 7 Drawing Sheets

30
35
4
5
34
57
65
39
31
38
64
33a
32
56
33
62
25
4
5

VEHICLE DOOR HANDLE UNIT

FIELD OF THE INVENTION

The present invention relates vehicle door handle units including a detection section for detecting locking/unlocking operation of a vehicle door or opening/closing-related operation including opening/closing operation of the vehicle door.

BACKGROUND OF THE INVENTION

Vehicle door handle units have been known which are equipped with a detection section including a sensor or switch for locking/unlocking operation of a vehicle door. Namely, these vehicle door handle units can automatically perform processing for locking/unlocking the vehicle door or opening/closing-related processing, including opening/closing of the vehicle door, in response to a vehicle driver or passenger, carrying an IC card or the like, touching the detection section. Japanese Patent Application Laid-Open Publication No. 2005-330752 (JP 2005-330752 A), for example, discloses such a vehicle door handle unit where a depressing portion of a push switch is exposed on the outer surface of a vehicle door handle section.

FIG. 7 is a view explanatory of a fundamental construction of the vehicle door handle unit disclosed in JP 2005-330752 A, and FIG. 8 is a sectional view taken along line 8-8 of FIG. 7. The disclosed vehicle door handle unit 200 includes a door-side member (door-side concave section) 202 fixed to a vehicle door (not shown), a support section 203 provided on an upper reverse surface portion of the door-side member 202, a handle section 205 pivotably attached to the support section 203 via a handle shaft 204, torsion springs (biasing members) 206 wound on the support section 203 and resiliently acting between the support section 203 and the handle section 205, and a push switch 209 supported by the door-side member 202 and having a depressing portion 208 exposed through an opening 207 of the handle section 205. The opening 207 is located close to one end of the handle section 205 as viewed in an axial direction of the support section 203. However, in the disclosed vehicle door handle unit, where the push switch (detection section) 209 is exposed on the outer surface of the handle section 205, the support section 203 supporting the handle section 205 is provided on the inner side of the vehicle door (i.e., side facing the interior of the vehicle), the door handle unit 200 would require a great overall depth or thickness, and thus it is difficult to apply the vehicle door handle unit 200 to small-size vehicles etc, having a small layout space. Further, because the push switch 209 is located close to the one end of the handle section 205 as viewed in the axial direction of the support section 203, the door handle unit 200 would have a poor usability.

SUMMARY OF THE INVENTION

In view of the foregoing prior art problems, it is an object of the present invention to provide an improved vehicle door handle unit which can be suitably applied to small vehicles etc. of which the vehicle door can only have a limited thickness, and which has a good usability, i.e. is very easy to use.

In order to accomplish the above-mentioned object, the present invention provides an improved vehicle door handle unit, which comprises: a handle shaft rotatably mounted on a vehicle door; a handle section pivotably mounted on the handle shaft; and a detection section for detecting locking/unlocking operation of the vehicle door or opening/closing-related operation including opening/closing operation of the vehicle door. The handle shaft comprises first and second handle shaft members axially spaced apart from each other, and the detection section is provided between the first and second handle shaft members.

With the detection section, it is possible to detect locking/unlocking operation of the vehicle door or opening/closing-related operation including opening/closing operation of the vehicle door. In this way, the vehicle door can be automatically locked/unlocked, for example, by a vehicle driver or passenger with an IC card or the like touching the detection section, as a result of which it is possible to significantly enhance convenience of the vehicle driver or passenger.

Further, with the detection section provided between the first and second handle shaft members of the handle shaft, the vehicle door handle unit can be constructed in a compact size. Further, with the detection section provided between the spared-apart first and second handle shaft members, it is possible to avoid the handle shaft and detection section from interfering with each other in the outward-inward direction (i.e., width direction) of the vehicle, and thus, the vehicle door handle unit can be suitably applied to small-size vehicles of which the door can only have a limited thickness.

In an embodiment, the detection section is provided to be located in a recessed section formed in the outer peripheral edge of the handle section when the handle section is in its non-operating position. Thus, the detection section and handle section can present a sense of unity in appearance, so that the outer appearance of the vehicle door handle unit can be significantly enhanced In an embodiment, the detection section is provided to project beyond an outer peripheral edge portion of the handle section adjacent to the handle shaft, and thus, it can be located as close to the handle shaft as possible. As a consequence, it is possible to secure a sufficiently great space for entry of a hand of the vehicle driver or passenger in operating the handle section.

In an embodiment, the detection section is provided to be located in an opening formed in the handle section when the handle section is in its non-operating position. Thus, the detection section and handle section can present an increased sense of unity in appearance, so that the outer appearance of the vehicle door handle unit can be even further enhanced.

In an embodiment, the detection section is provided in a middle region of the handle section as viewed in the axial direction of the handle shaft. Thus, the first and second handle shaft members can have substantially the same length, so that these two shaft members can be located symmetrically about the axial center of the handle section. As a consequence, not only the pivoting operation of the handle section can be performed stably, but also the vehicle door handle unit can have an increased usability, i.e. can be used with an increased ease.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

Figure 1:
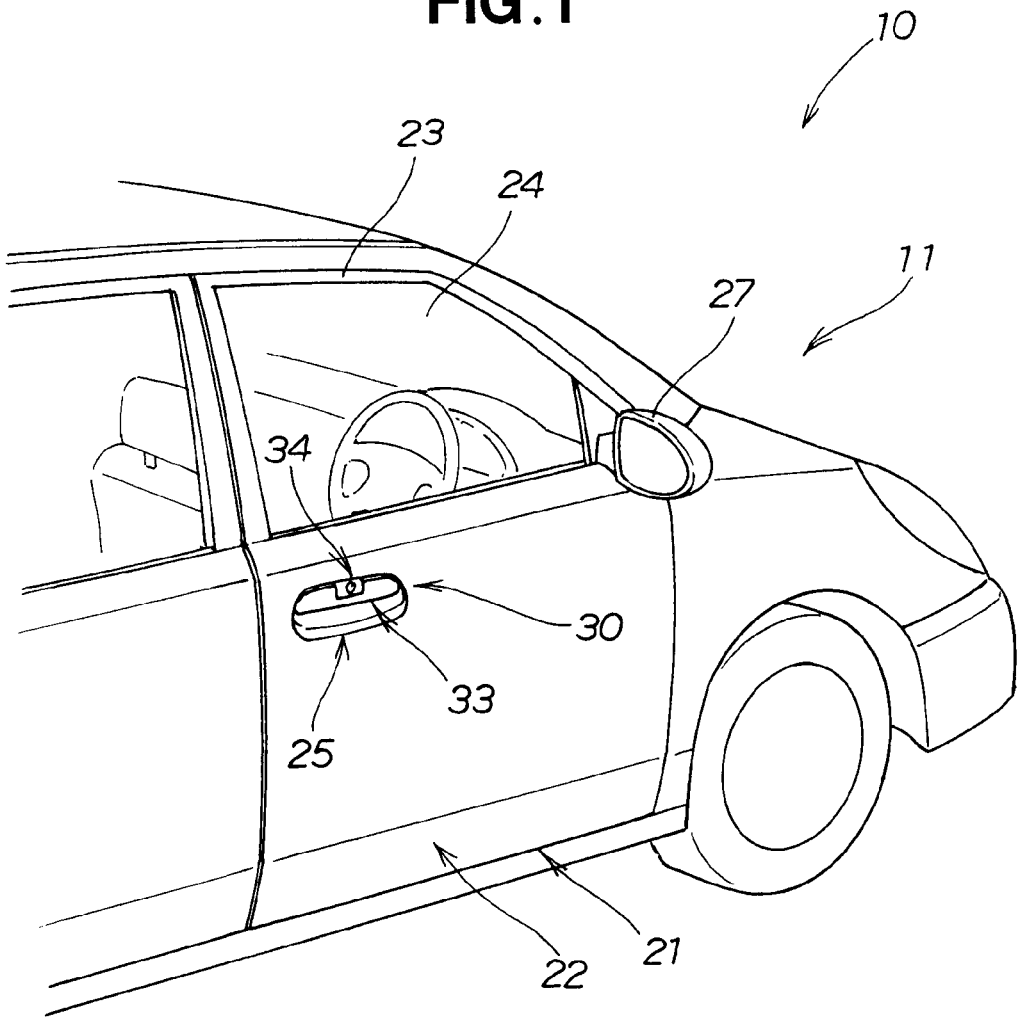
FIG. 1 is a perspective view of a vehicle employing a vehicle door handle unit according to a first embodiment of the present invention.
Figure 2:
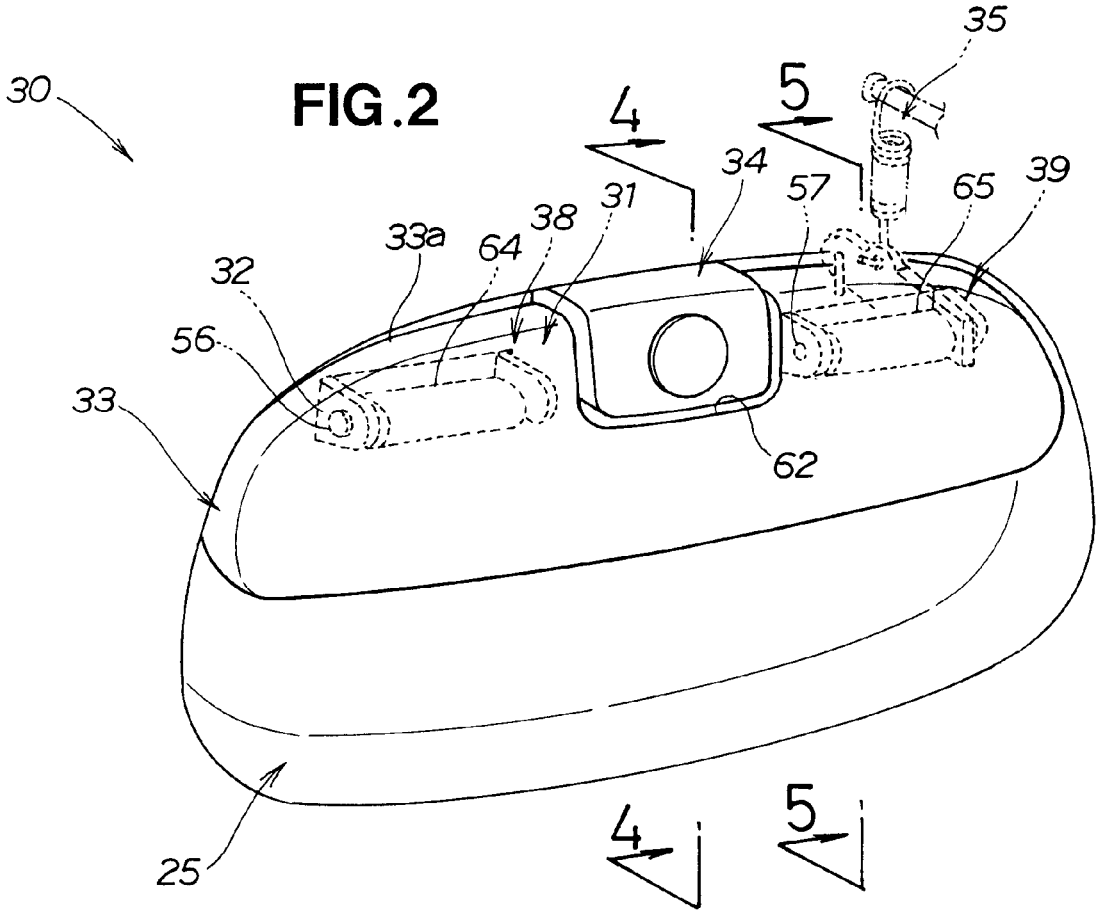
FIG. 2 is a perspective view of the vehicle door handle unit shown in FIG. 1.

FIG. 1 is a perspective view of a vehicle employing a vehicle door handle unit 30 according to a first embodiment of the present invention, and FIG. 2 is a perspective view of the vehicle door handle unit. The vehicle 10 includes a vehicle door 21 attached to a vehicle body 11 for opening and closing movement to allow a vehicle driver or passenger to get in and out of the vehicle.

The vehicle door 21 includes a door body 22 openably/closeably attached to the vehicle body 11, a window frame 23 attached to an upper portion of the door body 22, a window glass 24 vertically movably mounted in the door body 22 and window frame 23, the vehicle door handle unit 30 pivotably attached to a door-side concave section of the door body 22, and a door mirror 27 attached to the door body 22.

The vehicle door handle unit 30 includes: a support section 31 formed in the door-side concave section 25 of the vehicle door 21; a handle shaft 32 attached to the support section 31; a handle section 33 pivotably mounted on the handle shaft 32; a detection section 34 mounted in the door-side concave section 25 and exposed through a recessed portion 62 between the handle section 33 and the vehicle door 21; and a biasing member 35 provided between the handle section 33 and the vehicle door 21 for normally urging the handle section 33 toward the vehicle door 21. The detection section 34 projects outwardly from an upper outer peripheral edge 33*a* of the handle section 33 adjacent to the handle shaft 32.

Figure 3:
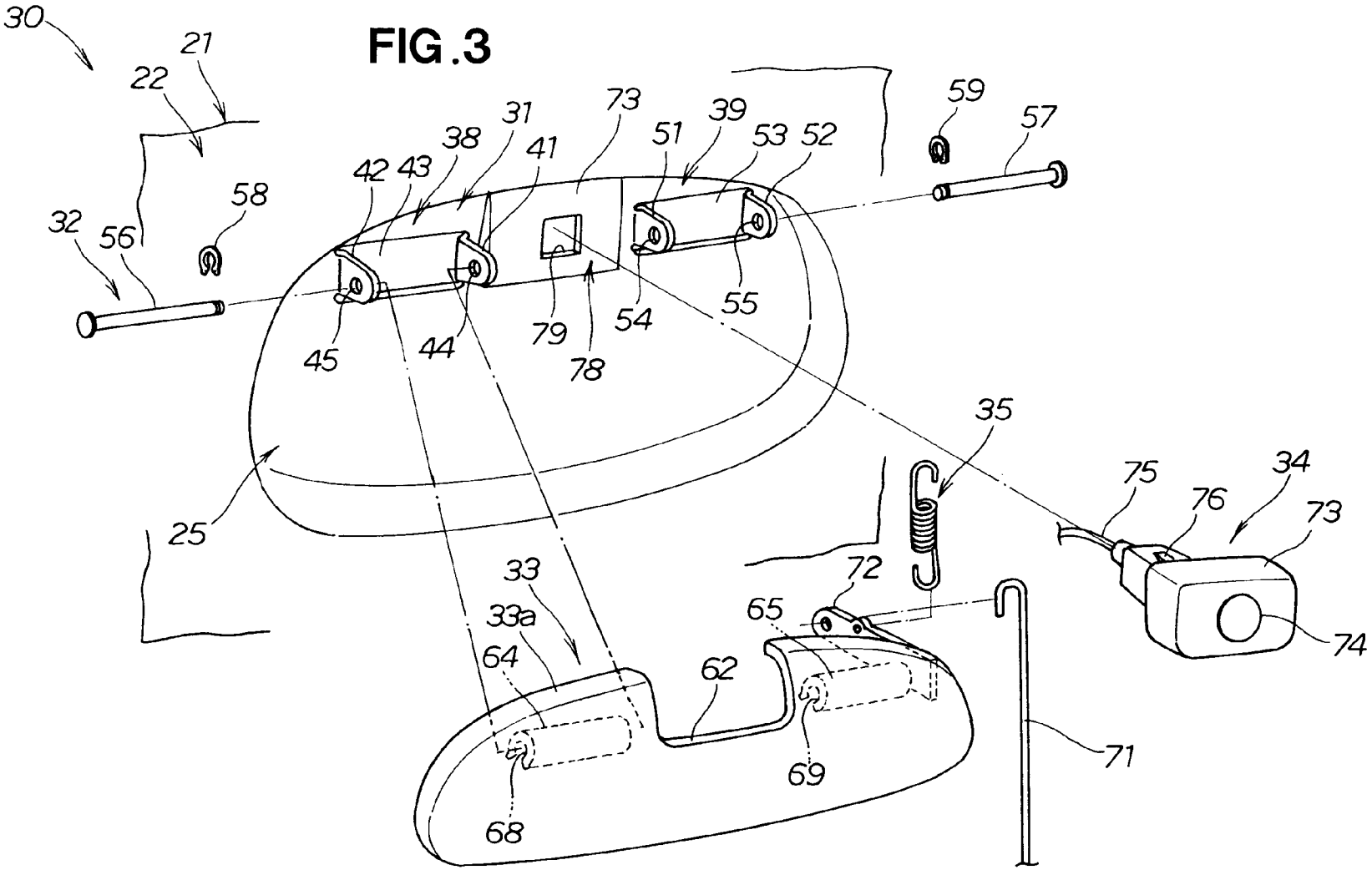
FIG. 3 is an exploded perspective view of the vehicle door handle unit shown in FIG. 2.
Figure 4:
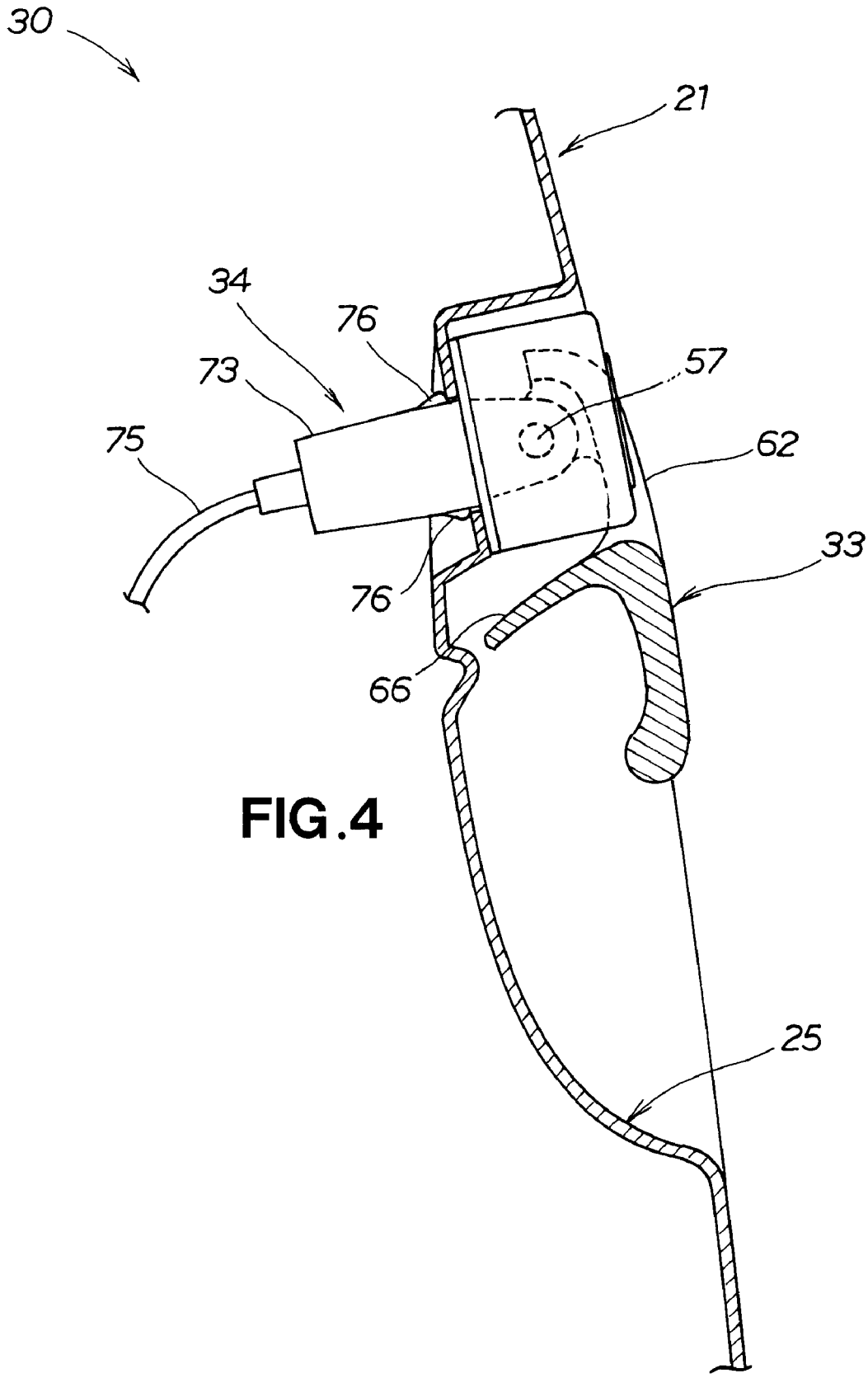
FIG. 4 is a sectional view taken along line 4-4 of FIG. 2.
Figure 5:
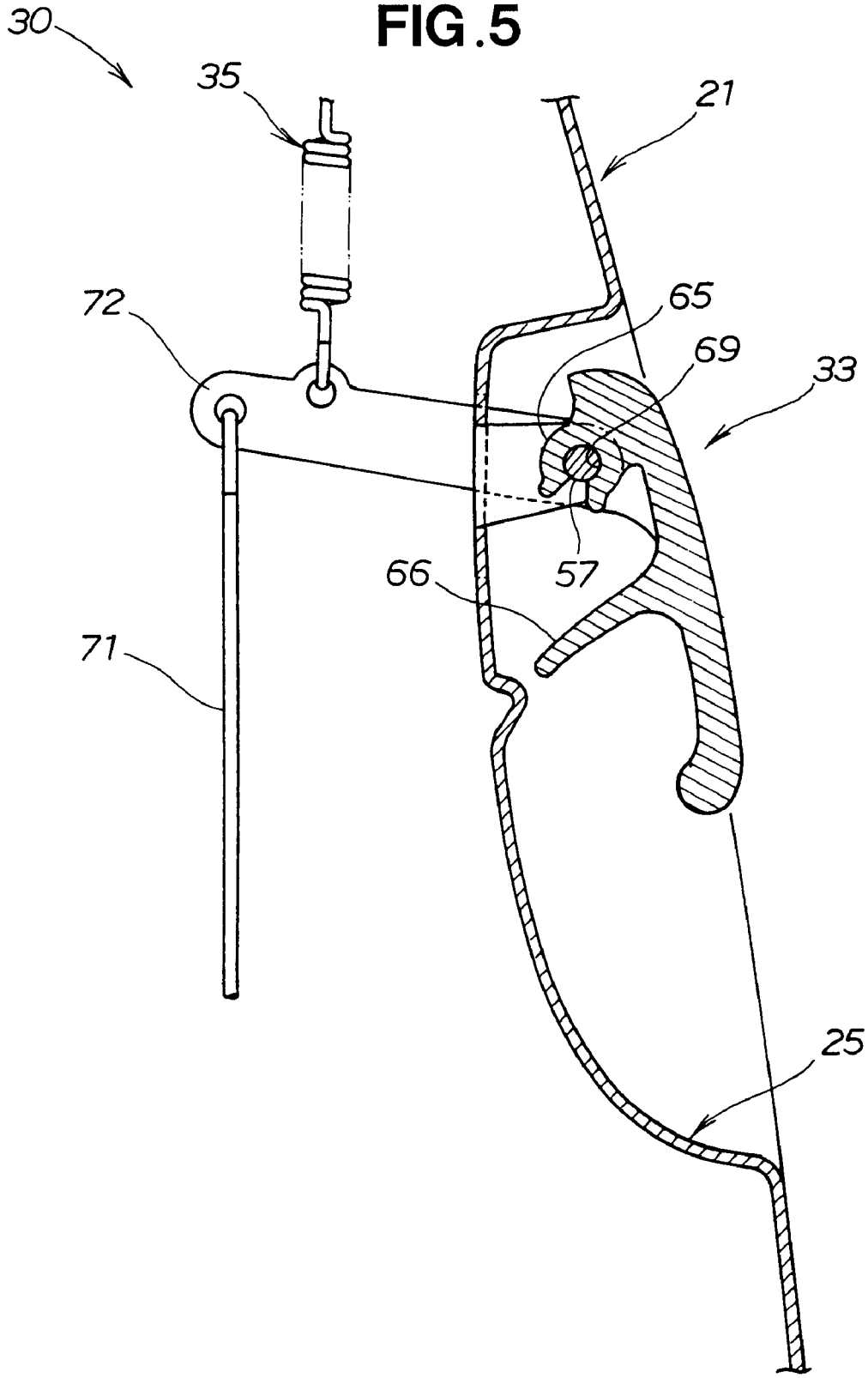
FIG. 5 is a sectional view taken along line 5-5 of FIG. 2.

FIG. 3 is an exploded perspective view of the vehicle door handle unit shown in FIG. 2, FIG. 4 is a sectional view taken along the 4-4 line of FIG. 2, and FIG. 5 is a sectional view taken along the 5-5 line of FIG. 2.

The support section 31 includes first and second support sections 38 and 39 supporting first and second handle shaft members 56 and 57 of the handle shaft section 32.

The first support section 38 includes inner and outer support portions 41 and 42 extending from the door-side section 25 of the vehicle door unit 21, and a first opening 43 formed between the support portions 41 and 42. The support portions 41 and 42 each have a hole 44 or 45 through which the first handle shaft member 56 extends.

Similarly, the second support section 39 includes inner and outer support portions 51 and 52 extending from the door-side section 25 of the vehicle door unit 21, and a second opening 53 formed between the support portions 51 and 52. The support portions 51 and 52 each have a hole 54 or 55 through which the second handle shaft member 57 extends.

The handle shaft 32 is of a two-divided structure comprising the first handle shaft member 56 that is mounted to the first support section 38 to pivotably support the handle section 33 and the second handle shaft member 57 that is mounted to the second support section 39 to pivotably support the handle section 33. The first and second handle shaft members 56 and 57 are axially spaced apart from each other. The first and second handle shaft members 56 and 57 are fixed to the first and second support sections 38 and 39 by means of retaining rings 58 and 59.

The handle section 33 includes: the recessed portion 62 formed in a middle region of the upper outer peripheral edge 33*a*, adjacent to the handle shaft 32, to allow the outer surface of the detection section 34 to be exposed; first and second fitting portions 64 and 65 provided to the left and right of the recessed portion 62 for fitting engagement with the first and second handle shaft members 56 and 57; and a guard wall 66 (FIG. 4) provided beneath the first and second fitting portions 64 and 65 to prevent a human hand from undesirably reaching portions, other than the outer surface, the detection section 34 and first and second fitting portions 64 and 65.

Namely, with the guard wall 66 formed on the handle section 33, the vehicle driver or passenger can put its hand into the door handle unit with an increased ease.

The first fitting portion 64 has a first bearing portion 68 having a substantially circular sectional shape opening over a circumferential region thereof so that it can be attached onto and pivotably supported on the first handle shaft member 56.

The second fitting portion 65 has a second bearing portion 69 having a substantially circular sectional shape opening over a circumferential region thereof so that it can be attached onto and pivotably supported on the second handle shaft member 57, and a lever 72 engaging with a connection member 71 extending inward from one end of the second bearing portion 69 and connected with a biasing member 35 in the form of a coil spring and with a locking/unlocking mechanism (not shown) of the vehicle door 21. The biasing member 35 normally urges the handle section 33 toward the vehicle door 21. The lever 72 extends through the second opening 53 inwardly of the vehicle door 21.

The detection section 34 includes a housing 73, a sensor 74 provided on the housing 73 for detecting locking/unlocking operation of the vehicle door or opening/closing-related operation including opening/closing operation of the vehicle door, and a harness 75 extending from the sensor 74.

As shown in FIG. 4, the detection section 34 further includes claws 76 formed on the housing 73, and it is engageable at the claws 76 in a locking hole 79 formed in a switch mounting portion 78.

Namely, in the vehicle door handle unit 30, the handle shaft 32 is rotatably mounted on the vehicle door 21, the handle section 33 is pivotably mounted on the handle shaft 32, and the detection section 34 is provided for detecting locking/unlocking operation of the vehicle door 21 or opening/closing-related operation including opening/closing operation of the vehicle door 21. Thus, with the detection section 34, it is possible to detect locking/unlocking operation of the vehicle door 21 or opening/closing-related operation including opening/closing operation of the vehicle door 21. In this way, the vehicle door 21 can be automatically locked/unlocked, for example, by the vehicle driver or passenger with an IC card or the like touching the detection section 34, as a result of which it is possible to significantly enhance convenience of the vehicle driver or passenger.

Further, because the detection section 34 is provided between the first and second handle shaft members 56 and 57 of the handle shaft 32, the vehicle door handle unit 30 having the detection section 34 can be constructed compactly. Further, with the detection section 34 provided between the spared-apart first and second handle shaft members, it is possible to avoid the handle shaft 32 and detection section 34 from interfering with each other in the outward-inward direction (i.e., width direction) of the vehicle, and thus, the vehicle door handle unit 30 can be suitably applied to small-size vehicles of which the door 21 can only have a limited thickness.

Further, because the detection section 34 is located in the upper recessed portion 62 formed in the upper outer peripheral edge of the handle section 33 while the handle section 33 is in its non-operating position, the detection section 34 and handle section 33 can present a sense of unity in appearance, so that the outer appearance of the vehicle door handle unit 30 can be significantly enhanced.

Furthermore, because the detection section 34 is provided so as to project beyond the upper outer peripheral edge 33*a* of the handle section 33 adjacent to the handle shaft 33, it can be located as close to the handle shaft 32 as possible. As a consequence, it is possible to secure a sufficiently great space for entry of a hand of the vehicle driver or passenger in operating the handle section 33.

Furthermore, because the detection section 34 is provided in a middle region of the handle section 33 as viewed in the axial direction of the handle shaft 32, the first and second handle shaft members 56 and 57 can have substantially the same length, so that these two shaft members 56 and 57 can be located symmetrically about the axial center of the handle section 33. As a consequence, not only the pivoting operation of the handle section 33 can be performed stably, but also the vehicle door handle unit 30 can be used with an increased ease.

Figure 6:
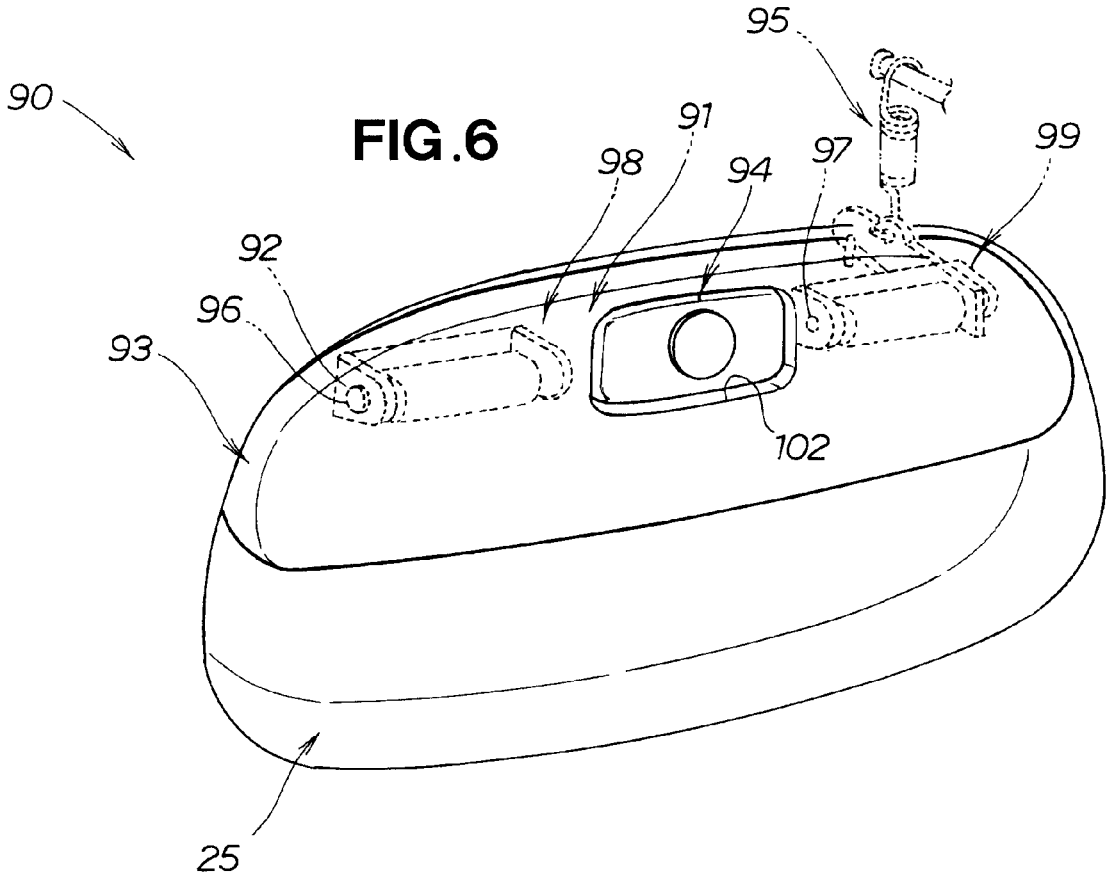
FIG. 6 is a perspective view of a vehicle door handle unit according to a second embodiment of the present invention.
Figure 7:
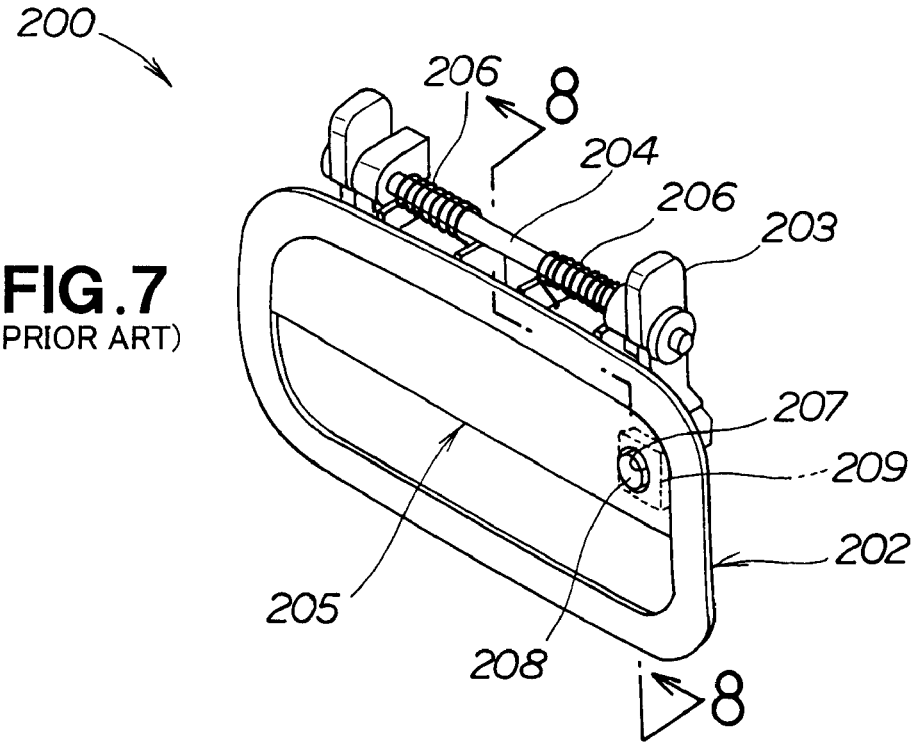
FIG.7 (PRIOR ART)
FIG. 7 is a view explanatory of a fundamental construction of a conventionally-known vehicle door handle unit.
Figure 8:
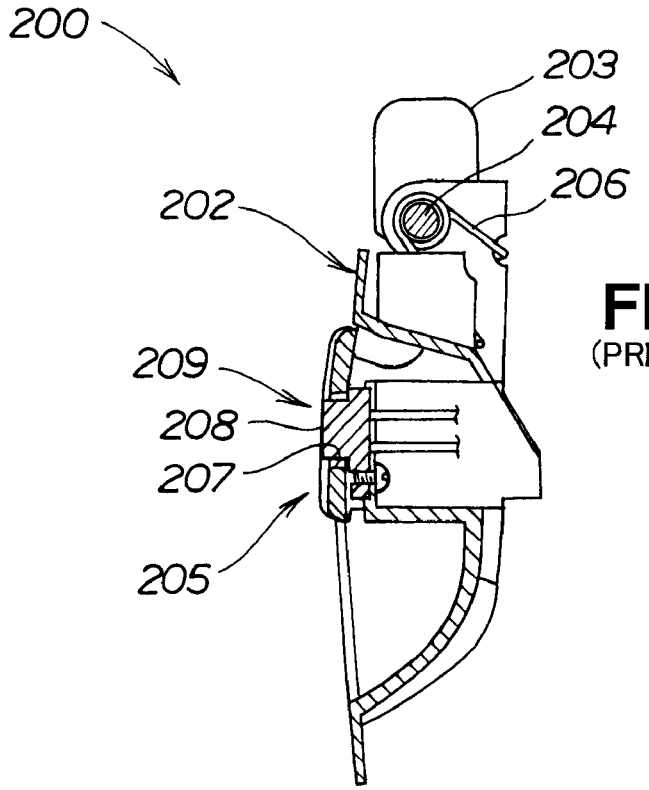
FIG.8 (PRIOR ART)
FIG. 8 is a sectional view taken along line 8-8 of FIG. 7.

FIG. 6 is a perspective view of a vehicle door handle unit 90 according to a second embodiment of the present invention. The vehicle door handle unit 90 includes: a support section 91 formed in the door-side concave section 25 of the vehicle door 21; a handle shaft 92 attached to the support section 91; a handle section 93 pivotably mounted on the handle shaft 92; a detection section 94 mounted in the door-side concave section 25 and exposed through an opening 102 formed in the handle section 93; and a biasing member 95 provided between the handle section 93 and the vehicle door 21 for normally urging the handle section 93 toward the vehicle door 21.

The handle shaft 92 is of a two-divided structure comprising a first handle shaft member 96 and a second handle shaft member 97 axially spaced apart from each other. The support section 91 includes a first support portion 98 supporting the first handle shaft member 96, and a second support portion 99 supporting the second handle shaft member 97.

The support section 91, handle shaft 92, handle section 93, detection section 94, biasing member 95 in the second embodiment are of generally the same constructions as the support section 31, handle shaft 32, handle section 33, detection section 34 and biasing member 35, except that the handle section 93 has the opening 102.

In the second embodiment, where the detection section 94 is located in the opening 102 formed in the handle section 93 when the handle section is not in its non-operating position, the detection section 94 and handle section 93 can present an increased sense of unity in appearance, so that the outer appearance of the vehicle door handle unit 90 can be even further enhanced.

The handle section 33 or 93 in each of the first and second embodiments 30 and 90 of the present invention has been described above as normally urged toward the door 21 by the biasing member 35 or 95 in the form of a coil spring (see FIGS. 2 and 6). However, the present invention is not so limited, and a torsion spring may be provided around each of the first and second handle shaft members 56 and 57, or 96 and 97 for normally urging the handle section 33 or 93 toward the door 21.

Further, whereas each of the first and second embodiments 30 and 90 of the present invention has been described above as employing the sensor 74 in the detection section 34 or 94 (see, for example, FIG. 3), the sensor 74 may be replaced with a mechanical switch, such as a push switch.

The vehicle door handle unit of the present invention is suited particularly for use in small-size vehicles, such as sedans and wagons.

Obviously, various minor changes and modifications of the present invention are possible in light of the above teaching. It is therefore to be understood that within the scope of the appended claims the invention may be practiced otherwise than as specifically described.

What is claimed is:

1. A vehicle door handle unit comprising:

a handle shaft rotatably mounted on a vehicle door;

a handle section pivotably mounted on said handle shaft;

a lever extending from the handle section; and a detection section for detecting locking/unlocking operation of the vehicle door or opening/closing-related operation including opening/closing operation of the vehicle door, wherein said handle shaft comprises first and second handle shaft members axially spaced apart from each other, and said detection section is provided axially between said first and second handle shaft members, and wherein each handle shaft member is supported by two support portions that extend outwardly from an outer door-side concave section of the vehicle door and the outer door-side concave section has an opening between each pair of support portions, said lever extending through one of the openings to operatively connect the handle section to a vehicle latch mechanism.

2. The vehicle door handle unit of claim 1, wherein said detection section is provided to be located in a recessed section formed in an outer peripheral edge of said handle section when said handle section is in a non-operating position.

3. The vehicle door handle unit of claim 2, wherein said detection section is provided to project beyond an outer peripheral edge portion of said handle section adjacent to said handle shaft.

4. The vehicle door handle unit of claim 1, wherein said detection section is provided to be located in an opening formed in said handle section when said handle section is in a non-operating position.

5. The vehicle door handle unit of claim 1, wherein said detection section is provided in a middle region of said handle section as viewed in an axial direction of said handle shaft.

6. The vehicle door handle unit of claim 1, wherein the first and second handle shaft members, and the detection section are horizontally-aligned when viewed laterally.

7. The vehicle door handle unit of claim 1, wherein the detection section is provided between the first and second handle shaft members when viewed laterally.

8. The vehicle door handle unit of claim 1, wherein the handle section comprises a guard wall provided beneath the first and second handle shaft members.

9. The vehicle door handle unit of claim 1, wherein the handle section comprises first and second bearing portions that engage the first and second handle shaft members, respectively, and the first and second bearing portions have a substantially circular sectional shape having an opening over a circumferential region thereof.

10. The vehicle door handle unit of claim 1, wherein the first and second handle shaft members are provided outside of the vehicle door.

11. The vehicle door handle unit of claim 1, wherein the detection section is provided axially between the first and second handle shaft members when viewed laterally.

* * * * *